United States Patent [19]

Ciallella

[11] Patent Number: 4,883,610

[45] Date of Patent: Nov. 28, 1989

[54] SOIL RELEASE PROMOTING LIQUID DETERGENT COMPOSITION CONTAINING A PET-POET COPOLYMER AND NARROW RANGE ALCOHOL ETHOXYLATE

[75] Inventor: Loretta K. Ciallella, Hopelawn, N.J.

[73] Assignee: Colgate-Palmolive Co., Piscataway, N.J.

[21] Appl. No.: 113,798

[22] Filed: Oct. 27, 1987

[51] Int. Cl.[4] ..... C11D 1/72; C11D 3/37; C11D 17/08; D06M 15/507

[52] U.S. Cl. ..... 252/559; 252/174.12; 252/174.21; 252/174.22; 252/174.23; 252/DIG. 1; 252/DIG. 12; 252/DIG. 14; 252/DIG. 15; 427/393.4

[58] Field of Search ..... 252/174.21, 174.22, 252/174.23, 174.24, DIG. 1, DIG. 14, DIG. 15, 559, 174.12, DIG. 12, 173; 427/393.4

[56] References Cited

U.S. PATENT DOCUMENTS

| | | | |
|---|---|---|---|
| 3,682,849 | 8/1972 | Smith | 252/174.21 |
| 3,985,687 | 10/1976 | Inamorato et al. | 252/557 |
| 4,132,680 | 1/1979 | Nicol | 252/547 |
| 4,368,147 | 1/1983 | Inamurator et al. | 252/545 |
| 4,441,881 | 4/1984 | Ruppert et al. | 8/137 |
| 4,474,678 | 10/1984 | Lutz et al. | 252/174.21 |
| 4,564,463 | 1/1986 | Secemski | 252/174.17 |
| 4,715,990 | 12/1987 | Crossin | 252/551 |

*Primary Examiner*—Dennis Albrecht

*Attorney, Agent, or Firm*—Bernard Lieberman; Murray M. Grill; Robert C. Sullivan

[57] ABSTRACT

Soil release promoting liquid detergent compositions, suitable for washing laundry and depositing soil release promoting copolymer on such laundry, are disclosed, which include a narrow range ethoxylate nonionic detergent (NRE), a soil release promoting compound which is a copolymer of polyethylene terephthalate and polyoxyethylene terephthalate (PET-POET copolymer), and water. Other desirable components of such compositions include fluorescent brightener, anionic detergent, enzyme, enzyme stabilizer or stabilizer system, co-solvent, water and adjuvants.

The liquid detergent is of a pH in the range of 7.3 to 8.1, of a viscosity in the range of 65 to 115 centipoises at 25° C., and is stable on storage, so that the soil release promoting activity due to the presence of the PET-POET copolymer therein is usefully maintained during storage. Also, in soil release promoting activity, the invented liquid detergent composition is unexpectedly better in removing oily soils from the polyester fabrics during low temperature washing than is an identical composition, except for the replacement of the NRE with broad range ethoxylated nonionic detergent (BRE), under the same washing conditions. Such result is highly beneficial and unexpected, and is especially significant with respect to polyester, polyester/cotton blends and nylon fabrics, such as those of mechanics' clothing, that has been stained by dirty motor oil, and similar soils containing particulate carbon in a lipophilic base. Significantly, the improvements in soil release promotion by the invented liquid detergents, compared to controls, are greater for those that have been aged before use.

6 Claims, No Drawings

SOIL RELEASE PROMOTING LIQUID DETERGENT COMPOSITION CONTAINING A PET-POET COPOLYMER AND NARROW RANGE ALCOHOL ETHOXYLATE

This invention relates to soil release promoting liquid detergent compositions. More particularly, it relates to such compositions which comprise narrow range ethoxylate nonionic detergent (NRE), soil release promoting polyethylene terephthalate-polyoxyethylene terephthalate copolymer (PET-POET) and water.

The novel soil release promoting liquid detergent compositions of this invention are surprisingly superior in soil release promoting action against oily soils and/or stains, compared to compositions which are identical except for replacement of the NRE with broad range ethoxylate detergent (BRE). Such unexpectedly beneficial effect is especially significant in cold water washing of nylon, polyester and polyester/cotton blend fabrics when the washing is effected at comparatively low temperatures, e.g., 20° C., and when the invented and comparative detergent compositions are both aged before use.

In the prior art it has been disclosed that soil release promoting polymers like those utilized in the present invention may be incorporated in detergent compositions, such as liquid detergent compositions, to deposit such copolymer on the laundry during washing and thereby to facilitate the removal of subsequently applied stains from the laundry when it is washed again. It also has been known that nonionic detergents are useful detersive components of liquid detergent compositions. In some liquid detergents both PET-POET copolymer and BRE have been utilized. However, it is considered that liquid detergent compositions comprising a combination of NRE and PET-POET copolymer are novel and because of the unexpectedly beneficial effect obtained from them, compared to other such compositions that are based on BRE's, unobviousness of the present invention has been established.

In accordance with the present invention a soil release promoting liquid detergent composition comprises a detersive proportion of a narrow range ethoxylate nonionic detergent (NRE), a soil release promoting proportion of soil release promoting compound which is a copolymer of polyethylene terephthalate and polyoxyethylene terephthalate (PET-POET) and water, which liquid detergent composition is of improved soil release promoting characteristics vs. oily soils on fabrics to be washed at low temperatures with aqueous wash water solutions of the detergent composition, compared to identical compositions in which the nonionic detergent component is a broad range ethoxylate nonionic detergent (BRE) being employed in a wash water to wash identically soiled fabrics. The improvement in soil release promoting characteristic vs. oily soils is especially notable for such soils which carry particulate matter (dirty motor oil, for example), and for nylon, polyester and polyester/cotton blend fabrics. Furthermore, as is very desirable, such improvement is even more significant, compared to effects obtained from uses of similar detergent compositions which include BRE instead of NRE, after aging of the products, which normally occurs before use thereof.

Prior art patents and a patent application which are relevant to this subject matter include: U.S. Pat. Nos. 4,441,881; 4,564,463; 4,771,287; and U.S. patent application Ser. No. 07/084,524 (Holland and Buda), filed August 10, 1987, all of which are hereby incorporated by reference. U.S. Pat. Nos. 4,441,881 and 4,564,463 disclose what are characterized as narrow range higher fatty alcohol ethoxylates in liquid detergent compositions containing a modified cellulose ether or methyl cellulose, which cellulose compounds are said to act to improve release of soils that had been deposited on fabrics after a previous washing of such fabrics with the detergent composition. However, neither of these patents mentions the employment of PET-POET copolymer soil release promoting agent, which applicant has found to coact with NRE's to significantly and unexpectedly improve soil release promotion, especially after aging of the liquid detergent compositions, compared to similar compositions based on BRE's. U.S. Pat. No. 4,661,287 discloses liquid detergent compositions comprising PET-POET copolymers and BRE nonionic detergents. However, this patent does not mention NRE's and does not disclose the unexpectedly desirable effects obtained from applicant's compositions. Finally, U.S. patent application Ser. No. 07/084,524 discloses built particulate detergent compositions comprising both PET-POET copolymers and NRE's. Such application also discloses improved soil release promoting by such compositions in cold water washing, compared to corresponding BRE-based compositions, but does not mention any improvement in such results after aging. Also, such application does not relate to liquid detergent compositions.

The NRE's that are employed in the invented liquid detergent compositions are nonionic detergents in which the hydrophilic moiety is an ethylene oxide polymer of comparatively narrow distribution, which distinguishes such detergents from those of similar types wherein the ethylene oxide polymer is of broader distribution (BRE's). Generally, it will be desirable, for improved detergency of the present compositions, for the ethylene oxide chain (including terminal ethanol to be of such narrow distribution that at least 80% of the nonionic detergent is of a number of ethylene oxide groups bracketing the average number of ethylene oxide groups in the NRE and in the range of $(n-3)$ to $(n+3)$, wherein n is the average number of ethoxies in the NRE detergent. In some instances the bracketing may be from $(n-2)$ to $(n+4)$ or from $(n-4)$ to $(n+2)$. Usually n will be about 6 or 7 but sometimes it can be in the range of 4 to 12. Preferably, the percentage of nonionic detergent of ethoxy content in the $(n-3)$ to $(n+3)$ range or either of the other two ranges previously mentioned will be at least 85% and more preferably at least 90%. Normally, the lower ethoxylated nonionic detergents or surfactants, such as those of 1 to 3 ethoxy groups per mole, will be limited to no more than 5%, preferably being less than 2% and more preferably being less than 1%. It is difficult to remove such lower ethoxylates entirely, due to the manufacturing method, which produces a range of nonionic detergents of different ethoxy contents, but in the NRE's the distribution curve may be considered as being "squeezed", resulting in a more uniform product. Corresponding BRE's will often have more than 5% of lower (1-3) ethoxy content. Of course, it is also desirable to limit the proportion of unethoxylated lipophile and the NRE's will normally contain less than 1% thereof and often less than 0.5% thereof, whereas BRE's often contain more than 1% of the lipophile, e.g., higher fatty alcohol.

The nonionic detergents (NRE's) of the invention are reaction products of ethylene oxide and a suitable lipophile or lipophilic material, which are manufactured catalytically. Higher alcohols, usually fatty or linear alcohols of 12 to 18 carbon atoms per molecule, which are usually preferably saturated, are the desired reactants with ethylene oxide to make the desired nonionic detergents for the compositions of this invention, but Oxo-type alcohols and middle phenols, such as nonyl phenols, may also be useful. Preferably the higher fatty alcohol moiety will be of 12 to 16 carbon atoms and will be linear, and more preferably it will be of 12 to 14 or 12 to 15 carbon atoms, e.g., lauryl alcohol, myristyl alcohol and mixtures thereof. The average ethoxy content of the NRE will be in the range of 4 to 10 EtO's per mole, preferably being 5 to 9 and more preferably, 6 to 8, e.g., 6.5 or 7. Other members of the well-known class of nonionic detergents, such as higher fatty acid esters of polyethoxy ethanol (but of narrow range ethoxylate distribution) may also be useful in some compositions and for particular applications. However, normally a higher fatty alcohol is employed as the source of lipophile and the product is a narrow range ethoxylate nonionic detergent that meets the NRE conditions previously recited.

NRE's that are presently available are preferably manufactured by catalytic reactions which promote the production of a narrow range of polyethoxylates, rather than the more conventional broad range of polyethoxylates in the more generally available commercial alkoxylated lipophile detergents. Products produced catalytically are characterized by a normal distribution curve when ethylene oxide content (abscissa) is plotted against weight percent (ordinate) but the peak of the "bell-shape" curve is much higher for the NRE than for the BRE nonionic detergents. It is considered that similar products, of similar distribution curves may be made by "topping" and "bottoming" BRE's or other NRE's, by removing higher and lower polyethoxylates by solvent extractions, distillations or by other suitable physical processes. The BRE nonionic detergents will include lower percentages of a narrow range of desired polyethoxylates, such as those of 4 to 10 EtO's, often less than 60% compared to more than 80% for the NRE's. They will also often include at least about 1% of all unit degrees of ethoxylation from 1 to 16 or 1 to 20, even when it is desired to have the average or mean ethylene oxide content at 6 or 7 moles per mole. On the other hand, the NRE which averages 7 moles of EtO per mole will usually contain no higher polymer of ethylene oxide than n=14 to 15, and the proportion of polyoxyethylene in the 4 to 10 range is significantly increased. Such increase and the narrow distribution range of the polyethoxy moieties apparently improve the soil release promoting properties of a liquid detergent composition when the NRE is included in a liquid detergent composition with a soil release promoting PET-POET copolymer, compared to similar BRE compositions. The reason for this effect is not understood.

Among the preferred NRE nonionic detergents employable in accordance with the present invention are Tergitol® Nonionic Surfactant 24-L-60N, which is of the formula $RO(CH_2CH_2O)_nH$, wherein R is a mixture of $C_{12}$ and $C_{14}$ linear alcohols and n averages about 7.0. Such product has a cloud point of 60° C. for a 1% aqueous solution and is a narrow range ethoxylate. Its properties are described in a product information bulletin issued by the manufacturer, Union Carbide Corporation, which carries the date of April, 1987. Other Tergitol Nonionic Surfactants which may also be employed, at least in part, with the 24-L-60N, include 26-L-60N, 24-L-45N and 24-L-75N, wherein the 60, 45 and 75 indicate cloud points, in degrees Centigrade. Also, it is considered that similar products, manufactured by Shell Chemical Company, which have been identified as Shell 23-7P and Shell 23-7Z, may be substituted, although the results may not be as satisfactory.

Ethoxylate distributions of the various NRE's are reported in Tergitol Surfactants Technical Service Bulletins entitled Ethoxylate Distribution of Tergitol 24-L Nonionic Surfactants by Gas Chromatography, issued by the Ethylene Oxide Derivatives Division of Union Carbide Corporation. The following table, Table 1, summarizes the ethoxylate distribution (by gas chromatography) of two of the preferred NRE's mentioned above, and of comparable BRE's.

TABLE 1

| | Weight Percent of $RO(CH_2CH_2O)_nH$ | | | |
|---|---|---|---|---|
| n | Tergitol 24-L-60N | Tergitol 24-L-60 | Tergitol 24-L-75N | Tergitol 24-L-75 |
| 0 | 0.6 | 1.3 | 0.3 | 0.9 |
| 1 | 0.2 | 0.9 | 0.0 | 0.6 |
| 2 | 0.4 | 1.8 | 0.2 | 1.2 |
| 3 | 1.1 | 3.1 | 0.4 | 2.0 |
| 4 | 2.7 | 5.4 | 1.2 | 3.6 |
| 5 | 6.6 | 7.0 | 3.1 | 5.3 |
| 6 | 13.1 | 9.0 | 7.6 | 6.8 |
| 7 | 19.5 | 10.3 | 14.3 | 8.6 |
| 8 | 21.5 | 11.1 | 20.3 | 10.6 |
| 9 | 16.3 | 11.2 | 20.6 | 10.9 |
| 10 | 9.5 | 10.0 | 15.5 | 10.5 |
| 11 | 4.1 | 8.0 | 8.8 | 9.4 |
| 12 | 1.3 | 6.3 | 3.9 | 7.6 |
| 13 | 0.4 | 4.3 | 0.9 | 5.5 |
| 14 | | 1.8 | | 2.2 |
| * Total | 97.3 | 91.5 | 97.1 | 85.6 |

*100% recovery of the sample is not achieved due to holdup of higher ethoxylates in the GC column The PET-POET copolymers of this invention will usually be of molecular weights in the range of 19,000 to 43,000, more preferably being about 19,000 to 25,000, e.g., about 22,000, according to molecular weight determinations performed on samples thereof that are usually employed herein. Such molecular weights are weight average molecular weights, as distinguished from number average molecular weights, which, in the case of the present polymers, are often lower. In the polymers utilized the polyoxyethylene will usually be of a molecular weight in the range of about 1,000 to 10,000, preferably about 2,500 to 5,000, more preferably 3,000 to 4,000, e.g., 3,400. In such polymers the molar ratio of polyethylene terephthalate to polyoxyethylene terephthalate units (considering

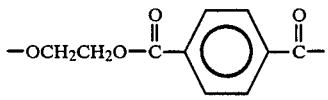

and

-continued

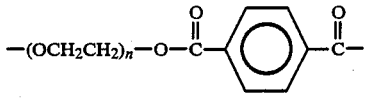

as such units) will be within the range of 2:1 to 6:1, preferably 5:2 to 5:1, more preferably 3:1 to 4:1, e.g., about 3:1. The proportion of ethylene oxide to phthalic moiety in the polymer will normally be at least 10:1 and often will be 20:1 or more, preferably being within the range of 20:1 to 30:1, and more preferably being about 22:1. Thus, it is seen that the polymer may be considered as being essentially a modified ethylene oxide polymer with the phthalic moiety being only a minor component thereof, whether calculated on a molar or weight basis. It was considered surprising that with such a small proportion of ethylene terephthalate or polyethylene terephthalate in the copolymer, such copolymer is sufficiently similar to the polymer of the polyester fiber substrate (or other polymers to which it is adherent, such as polyamides) as to be retained thereon during washing, rinsing and drying operations.

Although the described PET-POET copolymer is that which is employed normally by applicant, in accordance with the present invention, and that which is highly preferred for its desired functions, other PET-POET polymers, such as some of those described in U.S. Pat. No. 3,962,152 and British specification No. 10088984, may also be employed and it is considered that they can sometimes be effective soil release promoting agents in the compositions of this invention. However, it is believed that the soil release promoting properties of such materials are usually inferior to those of the preferred polymers.

The PET-POET copolymers useful in the practice of the present invention are available from Alkaril Chemicals, Inc. in powder or aqueous dispersion form, as Alkaril QCF (powder) and Alkaril QCJ (aqueous liquid). Of course, for the manufacture of liquid detergent compositions such as those of this invention, use of the QCJ product is preferred.

The fluorescent brightening compound(s) of the present composition is/are one(s) which is/are substantive to the washed laundry and serve(s) to convert invisible radiation to visible light, thereby appearing to whiten laundry surfaces on which it/they has/have been deposited. Such fluorescent brighteners constitute a well-known class of materials in the detergent art and therefore they need not be described at great length herein. Suffice it to say that they will normally be of the stilbene type, and more specifically, they will be of the stilbene sulfonic acid or sulfonic salt type. Among such brighteners employed in the compositions of the present invention are those manufactured by Mobay Chemical Corp. and sold under the trade marks Phorwite HRS and Phorwite BHC, which are, respectively, 4,4'-bis-4-anilino-6-(methylamine)-s-triazin-2-yl amine-2,2'-stilbene disulfonic acid, and 4,4'-bis-(4-phenyl-2N-1,2,3-triazol-2-yl)-1,2'-stilbene disulfonic acid, potassium salt. Although the mentioned fluorescent brighteners operate very effectively in the present compositions, it is considered that other types of substantive brightening agents may be employed instead, without loss of the unexpected beneficial improvement in soil release that is characteristic of the invented compositions.

An anionic detergent is also included in preferred embodiments of the present liquid detergent to improve the substantivity of the fluorescent brightener, and also to add its detersive properties to the composition (anionic detergents being especially effective in removing particulate soils from fabrics). The anionic detergent is preferably of the sulfate or sulfonate type, normally being in the form of a water soluble salt, such as an alkali metal salt, e.g., sodium salt. Such detergents are described at length in various texts, including *Surface Active Agents* (*Their Chemistry and Technology*) by Schwartz and Perry, and the various annual editions of John W. McCutcheon's *Detergents and Emulsifiers*. Although higher fatty alcohol sulfates and various other sulfates and sulfonates may be employed, it is preferred that the detergent be a higher alkylbenzene sulfonate, such as one wherein the alkyl is of 12 to 18 carbon atoms. More preferably, the alkyl is linear and is of 12 to 16 carbon atoms, e.g., dodecyl, and the cation is sodium.

The enzyme component of the present compositions may be any suitable enzyme which is effective against a type of soil expected to be encountered on laundry to be washed with the liquid detergent. The most important of such enzymes are the proteolytic and amylolytic enzymes, and mixtures thereof are preferable. Such mixtures will normally contain on part of proteolytic enzyme to 0.5 to 2 parts of amylolytic enzyme, with approximately equal proportions often being preferred. A suitable commercial product is that sold under the trademark Alcamyl, which is manufactured by Novo Industrii, but other products of the Maxatase® type may also be acceptable. Enzymes may be compounded with carriers or may be dissolved or dispersed in liquid media to facilitate more accurate weighing and formulation. In the manufacture of the compositions of the present invention it is usually preferred to employ liquid preparations of the mentioned dual enzymes, which dissolve more readily than powders.

A stabilizer or a stabilizing combination is normally present with the enzyme(s); it helps to prevent diminution in enzymatic activity after storage of the liquid detergent composition containing the enzyme or enzyme mixture. Suitable stabilizers include lower carboxylic acid salts, usually of 1 to 3 carbon atoms, which are preferably alkali metal salts, e.g., sodium salts. Of the lower carboxylic acid salts the formates are preferred, with the most preferred such stabilizer being sodium formate. More preferably, the mentioned enzyme stabilizer will have with it water soluble calcium and/or magnesium salt(s), preferably salts of strong organic acids, such as calcium chloride, magnesium chloride and/or magnesium sulfate. Such salt(s) form a stabilizing system with the lower carboxylic acid salt(s) and improve stabilization of the enzyme(s) present.

Because it is recognized that not all the desired components of the liquid detergent composition are readily soluble in the aqueous medium it is often desirable to employ a co-solvent, to assist in dissolving such components (such as the fluorescent brightener) and to help in preventing stratification of the liquid detergent composition or settling out of components thereof. The co-solvent may also perform an anti-freeze function, helping to maintain the composition uniformly liquid even when temperatures drop below freezing. Preferred co-solvents are low molecular weight polar organic compounds, which are preferably lower alkanols, such as ethanol or isopropanol, with ethanol (which is normally denatured) being preferred. Such a cosolvent may be mixed with another solvent, such as a diol or a polyol to make a more complex co-solvent system. Among suitable such diols and polyols are glycerol and glycols.

The water employed may be tap water, distilled water or deionized water, or it may be treated water, such as boiler feed water taken from the boiler feed system of the manufacturing plant. It is normally desirable that such water be of relatively low hardness, and normally it will be of a hardness less than 100 p.p.m., as $CaCO_3$, preferably less than 50 p.p.m., and more preferably, it will be about zero hardness.

Various adjuvants may be included in the invented composition, of which perfume and colorant will be those most commonly employed. The perfume will normally be lipophilic but will be readily solubilized by the surface active and solvent components of the composition. The colorant may be a water dispersible finely divided pigment but it is usually preferable to employ a water soluble dye or mixture of suitable such dyes, with mixtures of dyes and pigments also being feasible. Other components of the invented composition which might be considered to be adjuvants are alkaline and acidic materials, which may be employed to adjust the pH of the liquid detergent to a desired range. Normally, it will not be necessary to employ both acidic and alkaline materials for pH adjustment but sometimes that may be desirable. A preferred acidic material is citric acid, which is preferably employed as an aqueous solution, e.g., 50% citric acid in water, and a preferred alkaline neutrlizing agent is aqueous sodium hydroxide, which is usually of a 38% $Na_2O$ concentration in water. Another adjuvant that is often preferably employed in the present composition is one intended to inhibit corrosion of metallic equipment in which the composition is stored, processed or transported. Among such anti-corrosion agents the most effective for the present compositionsare the alkali metal nitrates, e.g., sodium nitrate.

The proportions of the various components of the present liquid detergent compositions will be held within certain ranges to obtain a product of the desired characteristics, which will be of improved detergency against oily stains, such as dirty motor oil, on a variety of fabrics, especially polyesters and cotton/polyester blends, and which will also be of acceptable appearance and physical characteristics. The major component of the invented liquid detergent compositions is water and the proportion thereof will normally be a sufficiently solubilizing proportion (in conjunction with any co-solvent that may be present) for the NRE, the PET-POET copolymer and any other components of the composition. The water content will be within the range of 50 to 85%, preferably being 60 to 80%, more preferably being 65 to 75%, and most preferably being 70% or about 70%. The proportion of NRE will be a detersive proportion, which usually will be in the range of 10 to 30%, preferably being 12 to 20%, more preferably being 14 to 18%, and most preferably being 16% or about 16%. The proportion of PET-POET copolymer will be a soil release promoting proportion, which will usually be in the range of 0.2 to 3%, preferably 0.5 to 2%, more preferably 0.7 to 1.5% and most preferably 1% or about 1%.

When fluorescent brightener or brightener mixture is present the proportion thereof will be a brightening proportion, in the range of 0.05 to 2%, preferably being 0.05 to 0.3%, and more preferably being 0.2% or about 0.2%. The proportion of anionic detergent is a brightener substantivity increasing proportion, within the range of 1 to 10%, preferably being 2 to 5%, and more preferably it will be 3.5% or about 3.5%.

The proportion of enzyme(s) will be an enzymatic proportion, within the range of 0.1 to 5%, preferably 0.3 to 3%, and more preferably it will be 0.8% or about 0.8%. Such proportions are based on the commercially supplied enzymes, including any carriers. The enzyme stabilizer or stabilizing system will be present in a stabilizing proportion, within the range of 0.5 to 6%, preferably 2 to 4%, and more preferably such proportion will be about 3%, e.g., 3.2%.

The co-solvent present will be in a co-solvent proportion within the range of 3 to 15%, preferably being 4 to 10%, and more preferably it will be 5% or about 5%. The total of adjuvant(s) present will be in a range of 0.1 to 5%, preferably 0.2 to 2%, e.g., 1% or about 1%. As to individual adjuvants the content of anti-corrosion compound will be in the range of 0.2 to 2%, preferably 0.3 to 1%, and more preferably will be 0.5% or about 0.5%. The amount of perfume will be in the range of 0.1 to 1.5%, preferably 0.2 to 1%, and more preferably will be 0.35% or about 0.35%. The neutralizing or pH adjusting agents' content will be in the range of 0.05 to 0.5%, preferably 0.1 to 0.3%, and more preferably will be 0.15% or about 0.15%. The content of dye or other colorant can be in the range of 0.00001 to 1%, preferably 0.00002 to 0.01%, and more preferably will be 0.00004% or about 0.00004%.

The soil release promoting liquid detergent composition made will normally be cloudy in appearance, and sometimes it may be made translucent. It can intentionally be made opaque, pearlescent, or cloudier by use of appropriate additives. The pH of the product will normally be in the range of 7.3 to 8.1, ideally being about 7.7, and the viscosity will normally be in the range of 65 to 115 centipoises at 25° C., preferably being about 90 cp.

Manufacturing the invented compositions is relatively simple, with almost no critical operations being required. Usually, the formula proportion of water or about 80% or more of such proportion is pumped to a mixing vessel or tank and the various components of the detergent composition are serially admixed in the aqueous medium, followed by addition of the balance of the water. Sometimes the co-solvent may be added first and at other times a portion thereof or all of it may be retained for subsequent addition with the balance of water, at or near the end of the mixing process. In many instances particular components, such as the fluorescent brightener, will first be dissolved in the co-solvent or in a portion of the water containing some or all of the co-solvent. Although such techniques may facilitate more rapid manufacture of the liquid detergent, in desired form and of desired appearance, usually the intended product is obtainable without practicing such process variations, except for pre-dissolving of the fluorescent brightener. After admixings of all the other components are completed, the balance of water, if any, may be added, also with stirring, and the pH may be adjusted. After pH adjustment and checking of the viscosity to make sure it is within specifications, the product may be bottled directly.

Using the invented composiions is simple and satisfactory, from the user's standpoint, there being little for the consumer to do except to measure out the desired amount of the liquid detergent composition and add it to the wash water in an automatic washing machine. Such machines will hold 60 to 70 liters of water, with about 67 liters being typical, and ½ cup of liquid detergent, which corresponds to about 120 grams thereof, will be employed per wash, although such amount may be varied, depending on the washer load and the extent of soiling of the items to be laundered. The laundry (usually about 6.5 lbs. or 3 kg., ±50%) is added to the wash water and the machine is turned on. The wash water will normally be of a hardness no greater than 300 p.p.m., as $CaCO_3$, and the water temperature will normally be in the range of 10° to 90° C. It is recognized that rarely, if ever, following American practice, will the temperature of the wash water approach boiling, but the washing and soil release promoting processes of this invention are operable at such higher temperatures. However, best comparative soil release promoting effects are obtained at lower temperatures. Preferably the water hardness will be no higher than 200 p.p.m., with the range of 100 to 200 p.p.m. being considered normal. Of course, lower hardness wash waters may also be used. Within the broad temperature range previously mentioned a preferred range is 10° to 50° C. and for most significantly improved soil release promotions, and resulting detergencies, compared to those obtained when similar BRE compositions are employed, such range will be 10° to 25° C., e.g., about 20° to 21° C.

Normally the washing cycle (during which the PET-POET copolymer is simultaneously being applied to laundry) will be 5 to 30 minutes, with a rinse cycle of 1 to 5 minutes, when an automatic washing machine is being utilized, and sometimes a plurality, usually 2 or 3, of rinse cycles can be used. Drying times will be between 10 and 60 minutes, with usual drying times being in the 20 to 40 minutes range, and drying will usually be at "normal" drying temperatures of automatic laundry dryers, rather than at "high" settings. Of course, both washing and drying conditions will be determined by the nature of the laundry, the soil and/or stains on it, and the characteristics of the washing and drying apparatuses being used. Top loading automatic washing machines will usually be employed, but side loading machines are also acceptable, and the recited advantages are also obtained when the laundry is hand washed and line dried.

In the washing-treating process it will be highly preferred to add the described liquid detergent composition to the washing machine but it is also feasible to add its various components, alone or in mixtures, to the washing machine, to produce essentially the same wash water composition. The wash water resulting will contain a detersive proportion of NRE and a soil release promoting proportion of PET-POET copolymer. Such proportions will be in the ranges of 0.01 to 0.1% and 0.0002 to 0.01%, respectively, preferably being 0.01 to 0.05% and 0.0005 to 0.006%, respectively, and more preferably being 0.02 to 0.04% and 0.001 to 0.005%, respectively, e.g., about 0.03% and about 0.003%, respectively. The concentration of fluorescent brightener will be within the range of 0.0001 to 0.01%, preferably 0.0002 to 0.001%, e.g., 0.0003%. The concentration of anionic detergent will be in the range of 0.001% to 0.03%, preferably 0.002% to 0.02%, e.g., about 0.007%. Concentrations of other components of the liquid detergent composition (except water) in the wash water, and ranges thereof, in percentages of wash water, may be obtained by multiplying such exemplified concentrations for the liquid detergent composition by 0.0018, for the ideal concentrations thereof in the wash water, or lower and upper percentage ranges of such concentrations may be calculated by multiplying the liquid detergent composition concentrations, in percentages, by 0.0010 (for the lower limit) and 0.0030 (for the upper limit). While, it is more preferred to employ the liquid detergent composition at a concentration in the wash water of about 0.18%, depending on the nature of the laundry such concentration may be within the range of 0.10 to 0.30% or within a narrower preferred range of 0.15 to 0.25%.

The following examples illustrate but do not limit the invention. Unless otherwise indicated, in such examples, in this specification and in the appended claims all parts are by weight and all temperatures are in °C.

EXAMPLE 1

EXAMPLE 1

| | Component | % |
|---|---|---|
| * | NRE Tergitol Nonionic Surfactant 24-L-60N | 16.00 |
| ** | Alkaril QCJ (15% aqueous solution) | 6.67 |
| *** | Fluorescent brightener | 0.16 |
| | Sodium linear dodecylbenzene sulfonate (52.5% active ingredient, in aqueous solution) | 6.67 |
| | Enzyme mixture (Alcamyl) | 0.75 |
| | Calcium chloride dihydrate | 0.17 |
| | Sodium formate | 3.00 |
| | Sodium nitrate | 0.50 |
| | Blue dye (CI Acid Blue 182, 0.38% aqueous solution) | 1.00 |
| | Ethanol (denatured with methanol) | 5.41 |
| | Perfume | 0.35 |
| | Sodium hydroxide (38% aqueous $Na_2O$ solution) for pH adjustment | q.s. |
| | Citric acid (50% aqueous solution), for pH adjustment | q.s. |
| **** | Water (softened) | 59.32 |
| | | 100.00 |

*A narrow range ethoxylate nonionic detergent which is a condensation product of higher fatty alcohol of 12–14 carbon atoms and an average of 7 moles of ethylene oxide per mole, with over 90% thereof of 4–10 ethoxylate groups per mole

**Polyethylene terephthalate-polyoxyethylene terephthalate copolymer of molecular weight of about 22,000, polyoxyethylene molecular weight of about 3,400, and molar ratio polyethylene terephthalate to polyoxyethylene terephthalate units of about 3:1

***Stilbene-type fluorescent brighteners (0.11% of Phorwite RKH and 0.05% of Phorwite BHC, both mfd. by Mobay Chemical Co.; any such brighteners may be substituted but they will preferably be of a stilbene sulfonate or stilbene sulfonic acid type)

****The percentage given is for compositions to which neither sodium hydroxide nor citric acid has been added (for pH adjustment). If either is employed, the percentage of water is decreased accordingly. Note that the percentage of water in the final liquid detergent composition is greater than indicated because some water accompanies various components.

A liquid detergent of the above composition is made by admixing all the components with the water in any suitable order, so long as the fluorescent brightener is dissolved early in the manufacturing process. Either sodium hydroxide solution or citric acid solution is added near the end of the mixing process to adjust the pH, either upwardly or downwardly, as may be required, and the perfume is normally added after pH adjustment is effected. Optionally, the mentioned components, some of which may be dissolved in the co-solvent or in aqueous co-solvent, may be admixed with a suitable proportion of the formula amount of water (such as ½ or 4/5), and the balance of water may be added last or shortly before pH adjustment and/or perfume addition.

The product resulting is a blue liquid, which is cloudy or translucent in appearance and which is of a viscosity of 90 centipoises at 25° C., measured with a Brookfield (RV) viscosimeter, using a No. 1 spindle, rotating at 20 revolutions per minute. The pH of the product is 7.7. The liquid detergent composition made is stable at room temperature for at least six months and often for a year or longer, without any stratification or settling out of components, and the soil release promoting activity of the PET-POET copolymer component remains high after storage, apparently due to the presence in the product of the NRE. If a BRE is substituted for the NRE substantial diminution in soil release promoting activity is noted after storage.

The invented liquid detergent composition is tested for soil release promoting effect against a control composition, identical therewith except for replacement of the Tergitol Nonionic Surfactant 24-L-60N by Neodol 25-7. Following is a description of the test procedure, using a normal wash water concentration of the liquid detergent compositions, 0.18%.

In the Tergotometer ® laboratory washing machine three rectangular polyester double knit switches, each measuring 7.6×10.2 cm., are pre-washed once together in one liter of wash water of 150 p.p.m. hardness, as $CaCO_3$, for ten minutes at a temperature of either 21° C. (cold water washing) or 38° C. (warm water washing), as desired. At the conclusion of washing the swatches are hand rinsed for about ten seconds, and are dried, and after drying reflectance readings are taken, using a reflectometer (Gardner XL20, for example). The average reflectance reading for the three swatches is taken as Rd (initial). The three swatches are then stained with three drops of dirty motor oil each and are allowed to age overnight. Reflectance readings are again taken and the average is Rd (stained). The pre-wash procedure is followed in washing the stained swatches and reflectance readings are again taken and are averaged, with the average being identified as Rd (washed). The percent of soil release obtained is calculated as $$\frac{Rd\ (\text{washed} - Rd\ (\text{stained})}{Rd\ (\text{initial}) - Rd\ (\text{stained})} \times 100.$$

Instead of employing the laboratory washing machine, a conventional home laundry washing machine may be utilized, with the same procedure being followed except that the swatches may sometimes be of a variety of fabric types, and will usually be larger in size, e.g., 10.2×15.2 cm., the wash water volume will be greater, e.g., 64.3 liters and the washing machine will be set for a normal ten minutes washing cycle, with accompanying normal rinse and spin cycles. The charge of liquid detergent composition in such tests is ½ cup per wash, which is 0.18%, based on the wash water.

The percent of soil release for the invented composition of the preceding formula is 74.2% (21° C.) while that for a control, an identical formula except for replacement of the Tergitol Nonionic Surfactant 24-L-60N by Neodol 25-7, is only 54.4%. The difference is considered to be very significant and there is no other apparent explanation for it except that the NRE and the PET-POET copolymer unexpectedly and beneficially act together to improve soil release promoting characteristics of the liquid detergent composition, so that oily soil, which may contain particulate materials, e.g., dirty motor oil, is removed significantly better from polyester and polyester blend fabrics by the invented liquid detergent composition than by similar compositions based on broad range ethoxylate nonionic detergents.

To make sure that the apparent "synergism" did not result from the Tergitol 24-L-60N being a soil release promoting agent, in and of itself, further control experiments were run, duplicating the experimental and control runs described above except for omissions of the Alkaril QCJ from the formulas. In such cases the percentage of soil release for the double control (that based on Neodol 25-7) was 7.4% and the percentage of soil release for the Tergitol 24-L-60N formula, without Alkaril QCJ, was 7.5%.

From the above data it is clear that the NRE detergent alone does not promote soil release any more than does the BRE detergent alone but the combination of NRE and PET-POET copolymer substantially improves soil release by the copolymer. Such improvement is unexpected and significant. The differences in the cleanings of the swatches are apparent to untrained viewers, and it does not require employment of sensitive measuring intruments to verify such differences.

When the laboratory test is repeated in a conventional washing machine substantially the same results are obtained. However, when the washing temperature is changed from 21° C. to 38° C. no appreciable differences in soil release promotion are apparent, but this may be due to the fact that at such higher wash water temperature the percentages of soil release are over 90% and therefore are near their maxima. It is considered that in cases where the fabrics are more severely soiled or stained than in the experiment described above the NRE-QCJ formulas will be significantly better in promoting soil release than the BRE-QCJ formulas.

EXAMPLE 2

The laboratory washing tests of Example 1 are repeated, but the test swatches are of nylon tricot and 65/35 polyester/cotton blend. In the 21° C. tests the invented composition releases 56.6% of the soil from the nylon whereas the control composition releases only 37.1%. The invented composition releases 57.4% of the soil from the polyester/cotton blend whereas the control releases only 49.7%. The differences at 38° C. are similar, with the invented composition besting the control by releasing 56.3% of the stain from the nylon compared to 47.8% for the control and releasing 52.0% from the blend of polyester/cotton, compared to 35.9% for the control. Furthermore, the differences in soil release are apparent to the naked eye.

The above example shows that the unexpected improvement in soil release characteristics of an invented composition, compared to a similar BRE composition, is not limited to polyester fabrics but applies also to nylon and polyester/cotton blend fabrics.

EXAMPLE 3

The testing procedure of Example 1 is repeated, but with both aged and new detergent compositions being employed, and with the washing being washing in a laboratory washing machine with the wash water at 38° C. Using newly made liquid detergent compositions, the invented composition releases 92.4% of the soil from the polyester fabric while the control composition releases 90.1%. Thus, the liquid detergent compositions are of substantially the same soil release promoting effects under such conditions. However, after accelerated agings of the detergent compositions for one week at 44° C. (110° F.) there is a dramatic difference, with the experimental product removing 88.6% of the soil whereas the control removes only 81.2%. Thus, it was found that the control deteriorates more rapidly in soil release promoting activity than does the liquid detergent composition of the invention.

The reported experiment also indicates that to maintain the soil release promoting activity of this type of liquid detergent composition it is important to employ NRE nonionic detergents, rather than BRE detergents. It was previously known that PET-POET copolymers in the present type of liquid detergent compositions (but based on BRE's) are destabilized by triethanolamine, which is employed in some liquid detergent compositions for its solubilizing effect on fluorescent brighteners, and it was known that ionizable salts also tend to have such a destabilizing effect. Therefore, the triethanolamine (TEA) content of PET-POET-containing liquid detergent compositions was minimized or the TEA was omitted entirely, and ionizable salt content was limited. Usually, for good soil release promoting action in NRE-PET-POET liquid detergent compositions the amount of TEA present should be limited to 1%, preferably to less than 0.5% and more preferably it will be omitted. With respect to ionizable salts, the concentration thereof should normally be limited to 10%, preferably 5% and more preferably 1% or less. For the compositions of this specification and of this example the content of ionizable salt will desirably be similarly limited, preferably to 5 or 10% of ionizable salt (1% when sodium formate and anionic detergent are not counted) and 0.1 or 0.2% TEA (but omitting it entirely is preferred).

Although the data presented in this example are with respect to testing at 38° C. it is considered that they are representative of the data that are obtained when the testing is at higher and lower temperatures, such as 21° C. Also, these data are considered to be consistent with results obtained after shelf storage of the liquid detergent composition for six months and for a year, or after accelerated agings for one or two months. However, after longer periods of storage or storage at higher temperatures the soil release promoting activity will be further diminished, so it is important that products to be marketed should be of highest initial soil release promoting effects, so that even when such effects are diminished the soil release promoting performance will be acceptable to the consumer.

EXAMPLE 4

When variations are made in the basic formula of Example 1, with replacement of the Tergitol 24-1-60N with comparable NRE's, such as 24-L-45N, 24-L-50N and 24-L-75N, essentially the same types of results are obtainable. Similarly, other NRE's, such as Shell 23-7P and Shell 23-7Z may be substituted, with similar results being obtainable in at least some such cases. Some variations may also be made in the PET-POET copolymer, such as increasing the weight average molecular weight thereof so that it is in the range of 30,000 to 40,000, and the desirable soil release promoting activities will be obtainable. Instead of the specified anionic detergent others may be employed, such as sodium lauryl sulfate, and other comparable alkylaryl sulfonates and alkyl sulfates. Different enzymes, enzyme stabilizers, copolymer stabilizers, co-solvents, fluorescent brighteners, dyes and perfumes may be employed, in accordance with the teachings of the specification. Similarly, the proportions of various components may be varied, such as ±10%, ±20% and ±30%, so long as they are kept within the ranges of proportions previously specified. In such cases the desirable effects of the invention will still be obtained The invention has been described with respect to working examples and illustrations thereof but it is not to be limited to these because it is evident that one of skill in the art, with the present specification before him, will be able to utilize substitutes and equivalents without departing from the invention.

What is claimed is:

1. A soil release promoting liquid detergent composition which comprises 12 to 20% of a narrow range ethoxylate nonionic detergent (NRE) which is a condensation product of a saturated higher fatty alcohol of 12 to 14 carbon atoms and an average of 6 to 8 moles of ethylene oxide per mole of such higher fatty alcohol, in polyethoxy ethanol groups, with at least 90% of the NRE being higher fatty alcohol ethoxylates of ethoxy contents in the range of 4 to 10 ethylene oxide groups per mole, 0.5 to 2% of a soil release promoting compound which is a copolymer of polyethylene terephthalate and polyoxyethylene terephthalate (PET-POET copolymer) which is of a weight average molecular weight in the range of 15,000 to 50,000 and in which the polyoxyethylene of the polyoxyethylene terephthalate of the PET-POET copolymer is of a molecular weight in the range of 1,000 to 10,000, and 60 to 80% of water, which liquid detergent composition is of improved soil release promoting characteristics vs. oily soils on polyester fabrics to be washed at low temperature with aqueous wash water solutions of the detergent composition, compared to identical compositions in which the nonionic detergent component is a broad range ethoxylate nonionic detergent (BRE) being employed in wash water at low temperature to wash identically soiled polyester fabrics.

2. A liquid detergent composition according to claim 1 which is free of triethanolamine and of triethanolamine salts, and comprises no more than 10% of ionizable salt(s).

3. A liquid detergent composition according to claim 1 which also comprises a brightening proportion, within the range of 0.05 to 2%, of a fluorescent brightening compound, a fluorescent brightener substantivity increasing proportion of an anionic sulfate and/or anionic sulfonate detergent, within the range of 1 to 10%, an enzymatic proportion, within the range of 0.1 to 5%, of an enzyme, a stabilizing proportion, within the range of 0.5 to 6%, of a stabilizer or a stabilizing system for the enzyme, a co-solvent proportion, within the range of 3 to 15%, of a polar organic co-solvent for the nonaqueous components of the liquid detergent composition, and any balance of adjuvant(s).

4. A liquid detergent composition according to claim 3 in which the NRE is a condensation product of a saturated higher fatty alcohol of 12 to 14 carbon atoms and ethylene oxide, averaging about 7 moles of ethylene oxide per mole of such higher fatty alcohol, the PET-POET copolymer is of a molecular weight in the range of 19,000 to 43,000, the fluorescent brightening compound is a stilbene brightener, the fluorescent brightener substantivity increasing anionic sulfate and/or sulfonate detergent is an alkali metal higher alkylbenzene sulfonate wherein the higher alkyl is of 12 to 18 carbon atoms, the enzyme is a mixture of proteolytic and amylolytic enzymes, the enzyme stabilizer includes an alkali metal lower carboxylic salt of 1 to 3 carbon atoms, the polar organic co-solvent is lower alkanol, the water is soft water, of a hardness less than 50 p.p.m., as $CaCO_3$, the adjuvants include perfume and colorant, and the proportions of such components in the liquid detergent are in the ranges of 14 to 18%, 0.7 to 1.5%, 0.05 to 0.3%, 2 to 5%, 0.3 to 3%, 2 to 4%, 4 to 10%, 65 to 75%, and 0.2 to 2%, respectively, in which liquid detergent composition the pH is in the rang of 7.3 to 8.1 and the viscosity is in the range of 65 to 115 centipoises at 25° C., and the PET-POET soil release promoting copolymer is stable on storage.

5. A liquid detergent composition according to claim 4 which is free of triethanolamine and of triethanolamine salts, and contains no more than 5% of ionizable salt(s).

6. A liquid detergent composition according to claim 4 consisting essentially of about 16% of NRE, about 1% of PET-POET copolymer, about 0.2% of stilbene fluorescent brightener, about 3.5% of sodium linear dodecylbenzene sulfonate, about 0.8% of mixed proteolytic and amylolytic enzymes, about 3% of sodium formate (enzyme stabilizer), about 0.2% of calcium chloride (enzyme stabilizing system component), about 5% of ethanol (co-solvent), about 70% of soft water, of a hardness of essentially zero p.p.m., as $CaCO_3$, about 0.5% of sodium nitrate, as an anti-corrosion agent, about 0.4% of perfume and about 0.00004% of colorant, which liquid detergent is of a pH of about 7.7 and of a viscosity of about 90 centipoises, at 25° C.

* * * * *